US005295385A

United States Patent [19]

Murai

[11] Patent Number: 5,295,385

[45] Date of Patent: Mar. 22, 1994

[54] BENDING APPARATUS

[75] Inventor: Shouichi Murai, Yamato, Japan

[73] Assignee: Murai Industrial Co., Ltd., Kanagawa, Japan

[21] Appl. No.: 35,589

[22] Filed: Mar. 23, 1993

[30] Foreign Application Priority Data

Apr. 23, 1992 [JP] Japan ..... 4-130056

[51] Int. Cl.[5] ..... B21D 5/02

[52] U.S. Cl. ..... 72/389; 72/382; 72/482

[58] Field of Search ..... 72/383, 389, 478, 481, 72/482, 382

[56] References Cited

U.S. PATENT DOCUMENTS 5,060,501 10/1991 Heath ..... 72/389

FOREIGN PATENT DOCUMENTS 0158527 7/1987 Japan ..... 72/389
0036923 2/1988 Japan ..... 72/389
0138669 1/1953 Sweden ..... 72/389

OTHER PUBLICATIONS

"One di-acro rol-form die", O'Neil-Irwin Mfg. Co., 4 pages, 1958.

*Primary Examiner*—David Jones
*Attorney, Agent, or Firm*—Wenderoth, Lind & Ponack

[57] ABSTRACT

A bending apparatus can preclude the generation of an undesired flaw in a workpiece during the bending of the workpiece and can readily cope with workpieces of various thicknesses. The apparatus has a die having a top groove of a W-shaped sectional profile, and a pair of blades disposed on top of the groove. The blades are supported for rotation and movement by mounting plates, and a spring biases the blades to horizontal positions atop the groove. The blades can be rotated and moved by a punch until the blades become seated in the groove. Spacers that constitute extensions of side wall surfaces of the die defining opposite sides of the groove are removable from the die and replaceable to vary the distance by which the side wall surfaces are extended in correspondence with the thickness of the workpiece to be bent.

8 Claims, 5 Drawing Sheets

BENDING APPARATUS

BACKGROUND OF THE INVENTION

1. Field of the Invention

This invention relates to a bending apparatus having a die and a punch for bending a sheet (i.e., a workpiece).

2. Description of the Related Art

Japanese Kokai Patent Publication H2-112826 discloses a bending apparatus for bending a composite (laminate) metal sheet comprising an outer and an inner metal sheet and a synthetic resin layer interposed between the two metal sheets. The purpose of this apparatus is to preclude a phenomenon of bending due to deviation of the outer and inner metal sheets. To meet this end, the apparatus comprises a first die, which has an end valley for constituting a V-shaped groove and is vertically movable, and a second die, which has wall surfaces for constituting the V-shaped groove. When the first die is pushed by the punch to be lowered to a predetermined position, its end valley becomes continuous to the inclined wall surfaces of the second die, thus completing the V-shaped groove. In a first stage of operation a V-shaped bend of short inclined surfaces is formed with the first die, and in the second stage a V-shaped bend of long inclined surfaces is formed with the first and second dies to thereby correct the bend formed in the first stage.

According to this teaching, however, there is a problem in that a flaw is provided in the workpiece along the boundary between the first and second dies.

Japanese Kokai Utility Model Publication H3-14010 discloses a bending apparatus, which, like the above bending apparatus, has a purpose of precluding the phenomenon of bending when bending a composite (laminate) metal sheet. The apparatus features a pair of steel receptacles having respective spherical or semi-cylindrical journals formed on the back side. The surfaces of the steel receptacles, on which the workpiece is set, are located on the outer side of the center of rotation of the journals. In this arrangement, in an initial stage of the bending process the workpiece undergoes the bending process while the steel plate receptacles are moved away from the bending line. Thus, the phenomenon of bending due to the pulling of the workpiece toward the bending line can be basically avoided. In addition, since the amount of friction between the workpiece and the steel receptacles is reduced during the bending process, it is possible to inhibit the generation of flaws due to the friction.

In this case, however, at the end of the bending process a gap is produced between the steel receptacles. Thus, it is impossible to apply back pressure to the outer surface of the workpiece near the radius portion, and it is thus difficult to make the bending radius smaller than a certain value. Further, a flaw is likely to be produced along the borderline between the steel receptacles and the workpiece.

Japanese Kokai Utility Model Publication H2-42718 discloses a bending apparatus which seeks to solve the above problem. This apparatus comprises a V-shaped die having a central V-shaped die groove, a pair of slidable supports of an elastic material provided at the ends of the V-shaped die, and rotary dies provided on the upper end of the slidable supports and having a semi-circular sectional profile. In the initial stage of the bending process, the workpiece is bent about its portion in contact with the punch with the descent of the punch and the rotation of the rotary dies, and at the end of the bending process the V-shaped die is brought into contact with the radius portion. Thus, accurate bending can be obtained.

However, again in this case an entire surface contact cannot be obtained although an end portion of the V-shaped die is brought into contact with the workpiece at the end of the bending process, thus posing the problem that a flaw is liable to be produced in the workpiece.

Japanese Kokai Patent Publication H2-11225 discloses a further bending apparatus, which, like the above bending apparatus, seeks to suppress the phenomenon of bending. To attain this aim, in a first step an elastic block is set in a V-shaped groove of a die for bending with a punch, and a second step of bending is performed with a workpiece reception die, which is made of two different elastic materials having different hardnesses.

However, again in this case the restoration of the elastic materials from deformation is deteriorated with the lapse of time. Therefore, the apparatus is not suitable for continuous operation. In addition, it is thought that the quality of bending is subject to deterioration with the lapse of time.

Further, the width of the V of the die that is required to preclude flaws from being produced in the workpiece is 5 to 6 times the thickness of the workpiece. In the above case, however, it is possible to cope with only a single workpiece thickness.

SUMMARY OF THE INVENTION

A first object of the invention is to provide a bending apparatus which can bend the workpiece without producing a flaw therein.

A second object of the invention is to provide a bending apparatus which can readily cope with workpieces of various thicknesses.

A suitable embodiment of the invention to attain the first object thereof is a bending apparatus having a die and a punch for bending a workpiece, which comprises: a groove formed in the top of the die, the groove being defined by a central triangular ridge and triangular valleys each defined on a side of the central triangular ridge so that the groove has a W-shaped sectional profile; a pair of blades having ears extending from opposite ends thereof, the blades being disposed on top of the die such that they extend along the groove, the blades being caused by the pushing pressure of the punch to undergo rotation and movement to be seated in the groove in a V-shaped form; a pair of mounting plates mounted on the opposite ends of the die and including means for permitting the rotation and movement of the blades; and means for restoring the blades to be horizontal.

Thus, by setting the workpiece on the blades and pushing it by lowering the punch, the pair of blades are rotated and moved in close contact with the workpiece before being seated in the groove. In this operation, full contact between the blades and the workpiece can be maintained until a predetermined bend angle is attained. Since the workpiece is not contacted by the die corner, no flaw is produced.

The means for permitting the rotation and movement of the blades are slots having a curved oval shape so as to allow a predetermined movement of the blades from the horizontal position toward the center of the mounting plates, the ears of the blades being received in the slots. Thus, the blades are seated in the groove without separation of their abutting portions, thus permitting sufficient bending of the workpiece.

The restoring means are springs linking ears extending from the pair of blades. Thus, when the pushing pressure exerted on the blades by the punch is relieved, the blades can be quickly restored to the horizontal state with a simple structure.

A suitable embodiment of the invention to attain the second object of the invention is a bending apparatus having a die and a punch for bending a workpiece which comprises: a groove formed in the top of the die, the groove being defined by a central triangular ridge and triangular valleys each defined on a respective side of the central triangular ridge so that the groove has a W-shaped sectional profile; spacers disposed on end portions of side wall surfaces of die defining opposite sides of the groove for extending the die wall surfaces by a predetermined distance; a pair of blades each having ears extending from opposite ends thereof, the blades being disposed on the top of the die such that they extend along the groove, the blades being caused by the pushing pressure of the punch to undergo rotation and movement to be seated in the groove in a V-shaped form; a pair of mounting plates mounted on the opposite ends of the die and including means for permitting the rotation and movement of the blades; and means for restoring the blades to horizontal positions.

Thus, by extending the opposite sides of the groove by disposing spacers on end portions of the side wall surfaces of the die, the position at which the reaction force exerted by the workpiece and blades against the punch is extended from the end portions of the side wall surfaces.

The distance of the extension provided by the spacers is determined in correspondence with the thickness of the workpiece. Thus, it is possible to set a V width which is optimum considering the thickness of the workpiece thus preventing a flaw from being produced in the workpiece. In addition, there is no need to replace the die itself, thus permitting cost reductions.

The means for permitting the rotation and movement of the blades are slots having a curved oval shape the ears of the blades being inserted in the slots. The restoring means are springs linking ears extending from each of the blades. The restoring means may, alternatively, comprise a vertical hole formed in the die, a coil spring accommodated in the vertical hole and a cap fitted on top of the coil spring and in engagement with adjacent portions of the pair blades. Thus, it is possible to obtain the same effects as the first embodiment of the invention to attain the first object thereof.

Further benefits and objects attainable by carrying out the invention will become understood from the detailed description of the preferred embodiments below made with reference to the accompanying drawings.

DETAILED DESCRIPTION OF THE PREFERRED EMBODIMENTS

Now, embodiments of the invention will be described with reference to the drawings.

Referring to FIGS. 1 to 4, there is shown a first embodiment of the invention.

Figure 1:
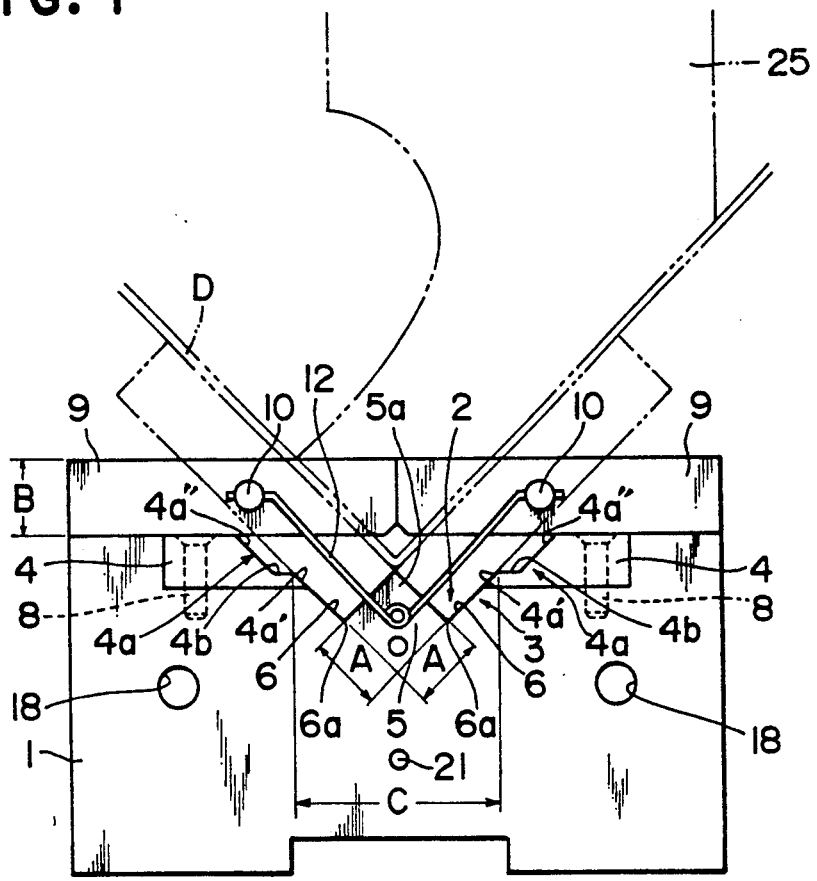
FIG. 1 is a side elevational view of a first embodiment of a bending apparatus according to the invention with the mounting plates being from illustration.
Figure 2:
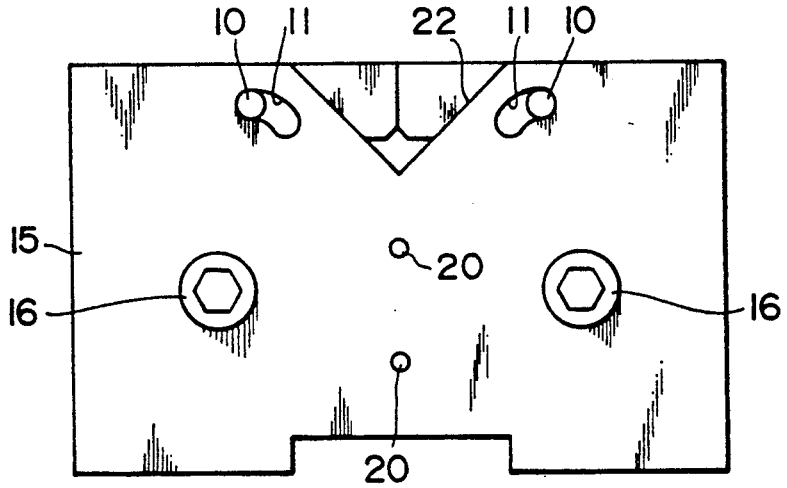
FIG. 2 is a side elevational view of the first embodiment of the invention showing a mounting plate secured to the die.
Figure 3:
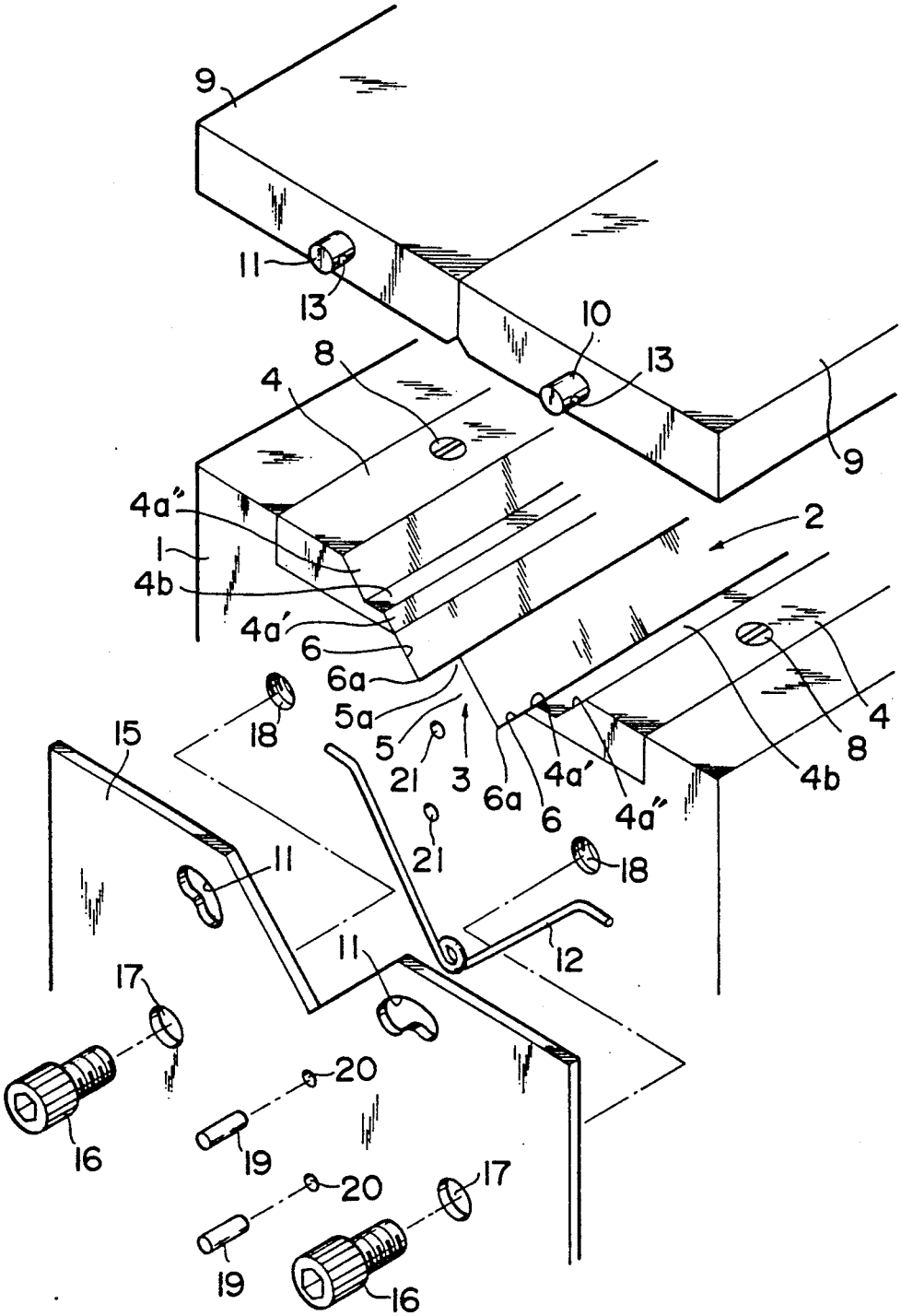
FIG. 3 is an exploded perspective view of the first embodiment.
Figure 4:
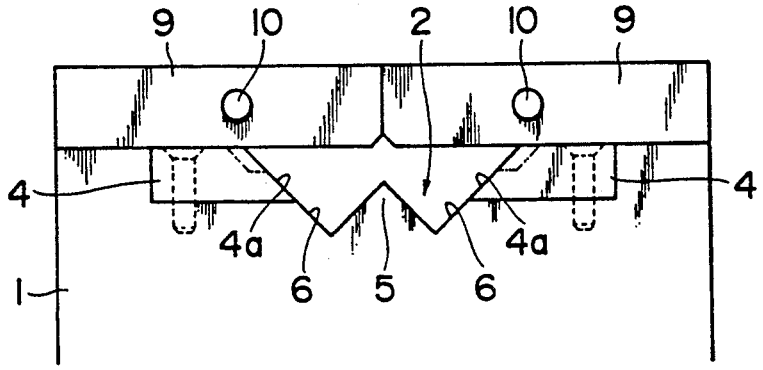
FIG. 4 is an elevational view of the first embodiment showing different spacers.

The illustrated structure has a die 1 which is configured to be mounted on a press. The die 1 has its top formed with groove 2. The groove 2 is defined by a portion 3 of the die 1 itself and by a pair of spacers 4. The die 1 has a central triangular ridge 5, which defines triangular valleys 6 on its opposite sides. The groove 2 thus has a W-shaped sectional profile as shown in FIG. 1 or 3. The distance A from the summit 5*a* of the ridge 5 to the bottom 6*e* of the valley 6 has to be equal to the thickness B of blades 9 to be described below.

A pair of the blades 9 are provided on top of the die 1 such that they extend along the groove 2. The blades 9 each have ears 10 extending from the opposite ends thereof. The ears 10 are inserted in slots 11 formed in mounting plates 15 to be described below, and they have diametrical through-holes 13. At each end of the blades 9, a spring 12 is fitted in the holes 13 for holding the paired blades 9 horizontal. Thus, when the pushing force of the punch 25 is relieved, the blades 9 having been pivoted into a V-shaped configuration are restored to their horizontal state by the restoring force of the springs 12.

The mounting plates 15 are mounted on end surfaces of the die 1, respectively. Each mounting plate 15 is secured to the die 1 by inserting screws 16 through holes 17 and into threaded holes 18. Each mounting plate 15 is positioned by positioning pins 19 inserted through positioning holes 20 and 21. Each mounting plate 15 has a central V-shaped notch 22, and a pair of the pair slots 11, noted above, formed on the opposite sides of the notch 22. The slots 11 each have a curved oval shape having an end portion from which the slot is downwardly curved toward the center of the mounting plate 15. The ears 10 noted above are inserted in the slots 11. The direction of movement of the blades 9 is restricted by the shape of the slots 11, in which the ears 10 of the blades 9 are inserted.

Figure 5:
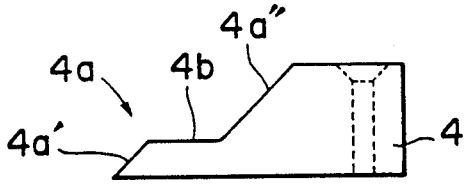
FIGS. 5(*a*)–5(*c*) are elevational views of various spacers.
Figure 5:
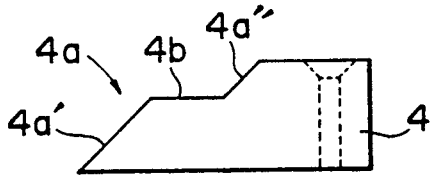
Figure 5:
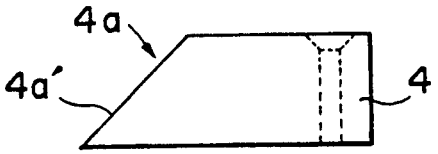

FIGS. 5(*a*) to 5(*c*) illustrate examples of the spacer 4. These spacers 4 generally have an inclined surface 4*a*, which constitutes an extension of each surface of the die 1 defining a side of the groove 2 formed in the die 1. In the spacers shown in FIGS. 5(*a*) and 5(*b*), the inclined surface 4*a* has a contact inclined surface 4*a*′, to be in contact with each blade 9, a step surface 4*b* extending from the contact inclined 4*a*′ and another contact surface 4*a*′extending from the step surface 4*b* and parallel to the contact inclined surface 4*a*′.

The V width of the die (shown at C in FIG. 1) usually has to be 5 to 6 times the thickness of the workpiece. With a fixed downward pressure applied by the punch 25, the V width has to be increased with increasing thicknesses of the workpiece.

Figure 6:
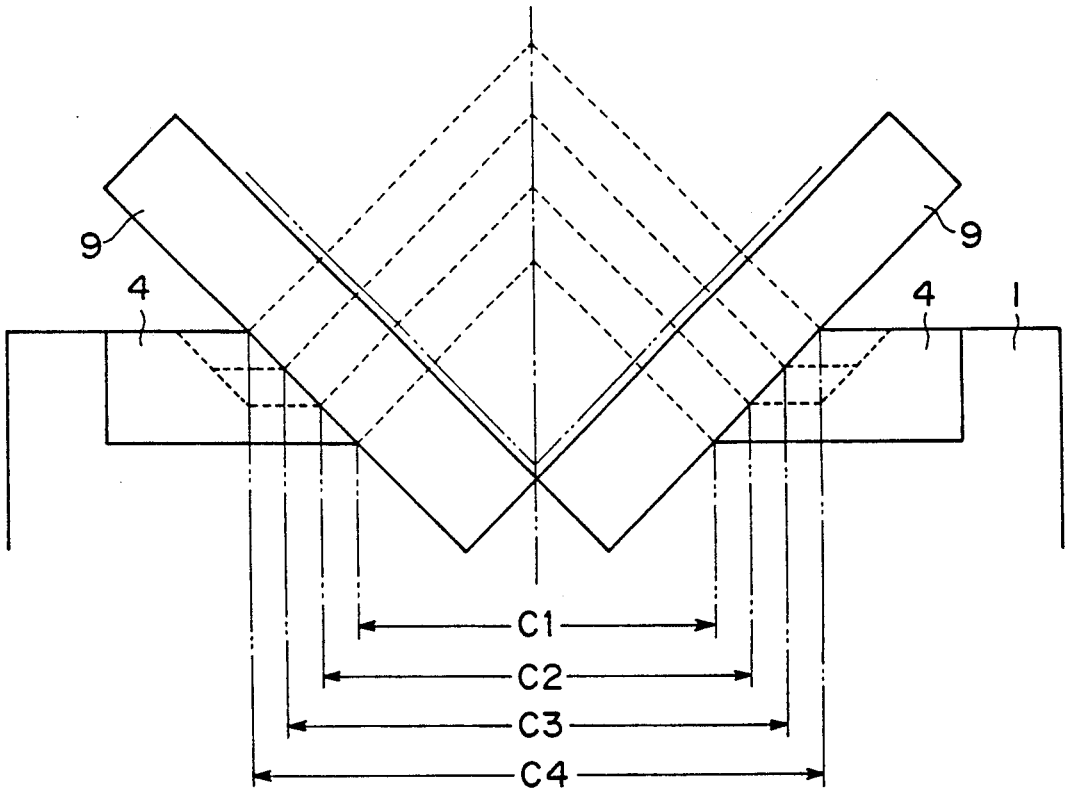
FIG. 6 is an illustration of the different widths of the V shape of the groove when various spacers are mounted.

Accordingly, in the first embodiment the spacers 4 are detachably mounted to the die 1 by screws 8. When the thickness of the workpiece is smallest, the spacers 4 are removed, as shown in FIG. 6, thus obtaining a V width C1 with the sole valley 6. For increasing thicknesses of the workpiece, the spacers 4 are replaced in the order of FIGS. 5(*a*) to 5(*c*) to obtain V widths C2 to C4 as shown in FIG. 6. In this way, the optimum V width of the die 1 corresponding to the thickness of the workpiece is selected.

An example of the operation of the bending apparatus having the above construction will now be described with reference to FIG. 1. The workpiece D is set on the blades 9 and then pushed by lowering the punch 25. As a result, the blades 9 in contact with the workpiece D are rotated about the ears 10 toward the punch, while at the same time they are moved as the ears 10 are moved along the slots 11, so that they are seated in the valleys 6. At this time, the portion of the workpiece D being bent is in direct contact with the blades 9, thus preventing the corner of the die from contacting the workpiece which would otherwise generate a flaw. In addition, it is possible to provide a V width which is suitable with respect to the thickness of the workpiece by appropriately selecting the spacers 4. Thus, the die is versatile, which contributes to manufacturing cost reductions.

Figure 7:
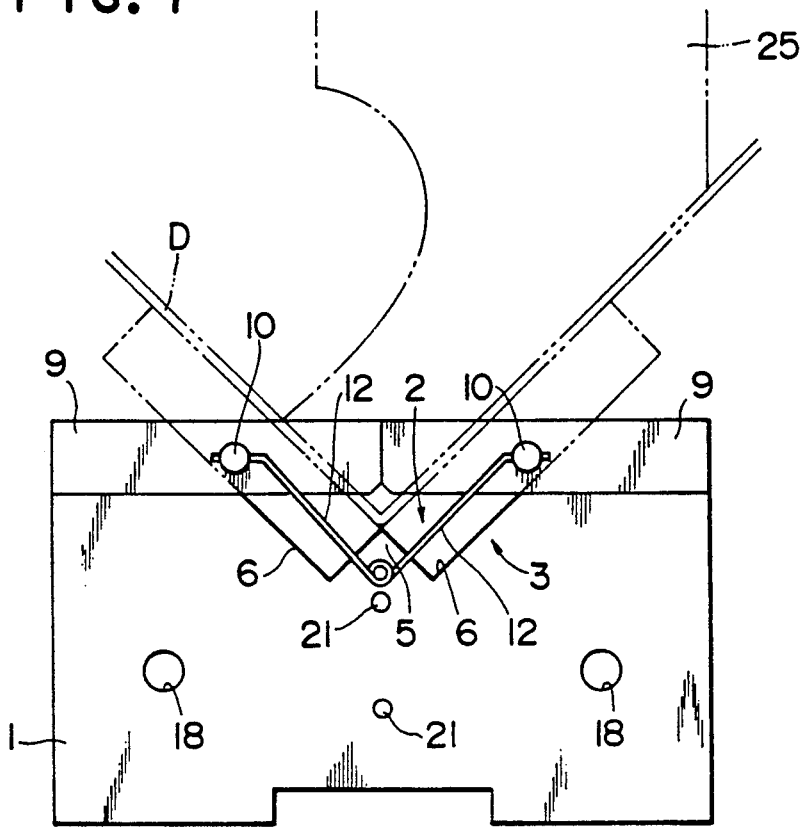
FIG. 7 is a side elevational view of a second embodiment of the invention.

FIG. 7 shows a second embodiment of the invention. If the thicknesses of the workpieces are equal, it is only necessary to provide the groove 2 of the die 1 with a predetermined V width. Thus, it is possible to dispense with the spacers 4. Parts like those in the previous embodiment are designated by like reference numerals and are not described any further.

Figure 8:
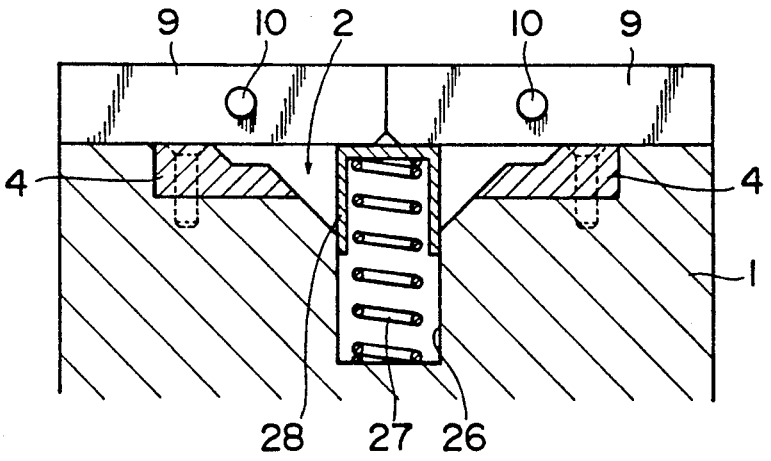
FIG. 8 is a side elevational view of a third embodiment of the invention.

FIG. 8 shows a third embodiment of the invention. In the first embodiment the springs 12 are provided between the ears 10 extending at the opposite ends of the blades 9. In this third embodiment, the die 1 is formed with a vertical hole 26. In the hole 26, a coil spring 27 is accommodated, and a cap 28 is provided on top of the spring 27. Thus, when the punch 25 is actuated, the blades 9 are bent into a V-shape against the force of the coil spring 27. When the pushing pressure is relieved, the blades 9 are restored to the horizontal state by the coil spring 27. The remainder of the structure is the same as the first embodiment, and like parts are designated by like reference numerals.

As has been described in the foregoing, according to the invention in the process of bending a workpiece the pair blades are held in close contact with the entirety of one side of the workpiece. Thus, it is possible to prevent the corner of the die from contacting the workpiece and generating a flaw. In addition, it is possible to suitably change the V width by replacing the spacers. Thus, it is not necessary to produce dies for various V widths, which contributes to manufacturing cost reductions.

In light of the above technical contents, various changes and modifications are of course possible. That is, the invention can be implemented in forms other than those specifically described above, and various modifications of the above embodiments may be made without departing from the spirit and scope of the invention as defined by the appended claims.

What is claimed is:

1. A bending apparatus comprising:

(a) a die having a top, a central triangular ridge and triangular valleys each defined on a respective side of said central triangular ridge in the top of the die, said ridge and said valleys together defining a groove in the top of the die having a W-shaped sectional profile;

(b) a pair of blades each of which blades has opposite ends and ears extending from the opposite ends, said blades being disposed on top of said die such that they extend along said groove;

(c) a pair of mounting plates mounted to said die on opposite ends of said die, respectively, each of said mounting plates having a pair of elongate slots, each of said slots having one end remote from said central triangular ridge and extending from said one end downward and along a curved path toward a central portion of the mounting plate adjacent said triangular ridge, the ears of said blades being received in and guided by said slots, respectively, such that said blades are allowed to rotate and move from horizontal positions to seated positions in which the blades together have a V-shaped configuration while seated in said groove against said die;

(d) means for restoring said blades to the horizontal positions; and (e) a punch disposed over the top of said die and movable toward said die to cause said blades to move from said horizontal to said seated positions thereof.

2. The bending apparatus according to claim 1, wherein said restoring means is a spring linking a pair of the ears extending from said blades.

3. The bending apparatus according to claim 1, wherein said restoring means comprises a vertical hole formed in said die, a coil spring accommodated in said vertical hole and a cap fitted on top of said coil spring and engaging said blades at portions of said blades lying adjacent to each other.

4. A bending apparatus comprising:

(a) a die having a top, a central triangular ridge and triangular valleys each defined on a respective side of said central triangular ridge in the top of the die, said ridge and said valleys together defining a groove in the top of the die having a W-shaped sectional profile;

(b) spacers disposed on end portions of side wall surfaces of said die defining opposite sides of said groove, said spacers constituting extensions of said side wall surfaces each of a predetermined distance;

(c) a pair of blades each of which blades has opposite ends and ears extending from the opposite ends, said blades being disposed on top of said die such that they extend along said groove;

(d) a pair of mounting plates mounted to said die on opposite ends of said die, respectively, and including means for permitting rotation and movement of said blades from horizontal positions to seated positions in which the blades together have a V-shaped configuration while seated in said groove against said die;

(e) means for restoring said blades to the horizontal positions thereof; and (f) a punch disposed over the top of said die and movable toward said die to cause said blades to move from said horizontal to said seated positions thereof.

5. The bending apparatus according to claim 4, wherein each of said spacers has an inclined contact surface having a length which corresponds to a thickness of a workpiece to be bent by the apparatus.

6. The bending apparatus according to claim 4, wherein said means for permitting the rotation and movement of said blades are slots having a curved oval shape, said ears of said blades being received in said slots.

7. The bending apparatus according to claim 4, wherein said storing means is a spring linking a pair of the ears extending from said blades.

8. The bending apparatus according to claim 4, wherein said restoring means comprises a vertical hole formed in said die, a coil spring accommodated in said vertical hole and a cap fitted on top of said coil spring and engaging said blades at portions of said blades lying adjacent to each other.

* * * * *